US005160279A

United States Patent [19]

Sagawa et al.

[11] Patent Number: 5,160,279

[45] Date of Patent: Nov. 3, 1992

[54] DOUBLE LOCK CONNECTOR

[75] Inventors: Tetsuya Sagawa, Yamato; Koji Aoyama, Machida; Muneo Oshima, Yokohama, all of Japan

[73] Assignee: AMP Incorporated, Harrisburg, Pa.

[21] Appl. No.: 797,497

[22] Filed: Nov. 22, 1991

[30] Foreign Application Priority Data

Nov. 26, 1990 [JP] Japan ..... 2-122456[U]

[51] Int. Cl.[5] ..... H01R 13/40

[52] U.S. Cl. ..... 439/595; 439/598; 439/752

[58] Field of Search ..... 439/595, 598, 752

[56] References Cited

U.S. PATENT DOCUMENTS

| | | | |
|---|---|---|---|
| 4,343,523 | 8/1982 | Cairns et al. | 339/59 M |
| 4,557,542 | 12/1985 | Coller et al. | 439/595 |
| 4,714,437 | 12/1987 | Dyki | 439/595 |
| 4,820,198 | 4/1989 | Lulko et al. | 439/595 |
| 4,932,899 | 6/1990 | Sueyoshi et al. | 439/595 |
| 4,944,696 | 7/1990 | Sueyoshi et al. | 439/595 |
| 4,950,182 | 8/1990 | Zielinski et al. | 439/595 |
| 5,069,639 | 12/1991 | Kodama et al. | 439/595 |
| 5,085,599 | 2/1992 | Maejima et al. | 439/598 |

FOREIGN PATENT DOCUMENTS

| | | |
|---|---|---|
| 0251518 | 6/1987 | European Pat. Off. . |
| 0374455 | 11/1989 | European Pat. Off. . |
| 2211031 | 7/1988 | United Kingdom . |

*Primary Examiner*—Paula A. Bradley
*Attorney, Agent, or Firm*—Adrian J. Larve

[57] ABSTRACT

An electrical connector (25) includes a stamped receptacle contact (15) crimped to a wire (17) and fitted into a plastic housing (30) having an interior lance (39) operable to lock the contact within the housing to receive a tab terminal contact inserted within the receptacle contact. A locking part (40) of a thin, flat plastic configuration is inserted within the housing (15) from the front (31), latched therein in a first position allowing contact insertion from the rear (32) of said housing and in a second position wedging the interior lance against displacement to provide a double locking of said contact; projections (43, 44) on the part (40) cooperating with projections (49, 52) on the interior of the housing in latching of said part relative to said housing in the first and second positions.

14 Claims, 3 Drawing Sheets

Fig. 4
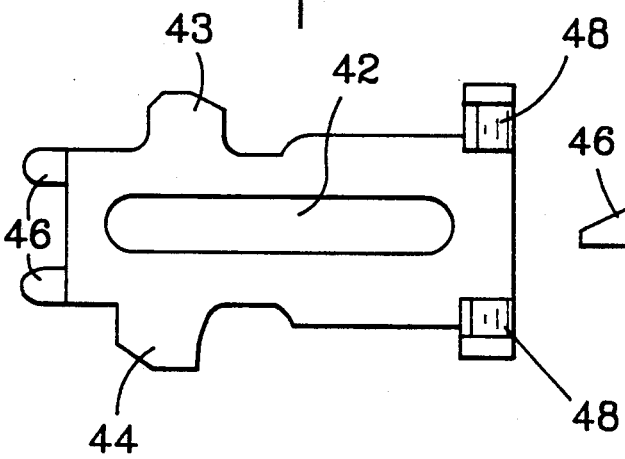
Fig. 5
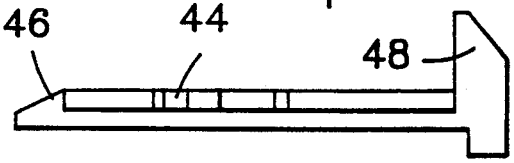
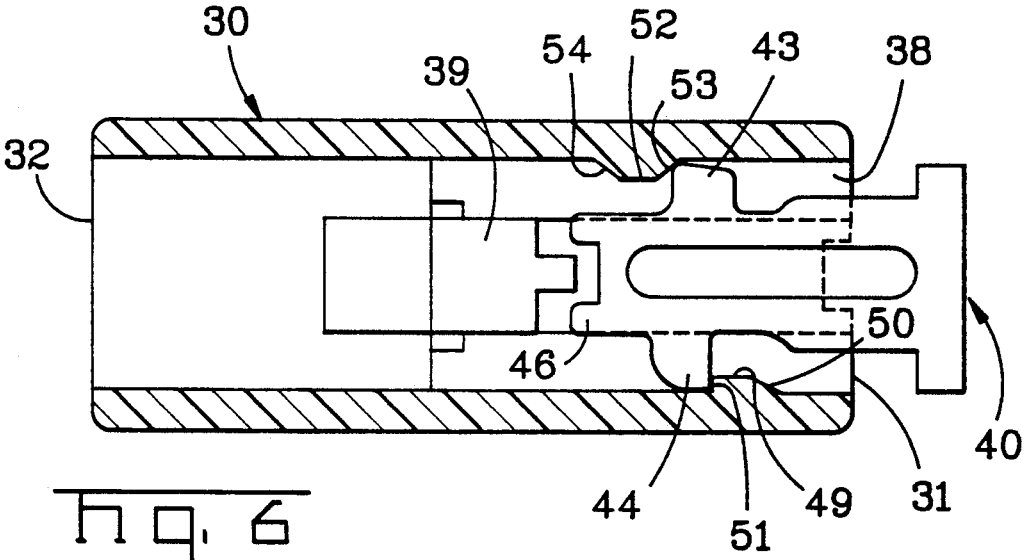
Fig. 6
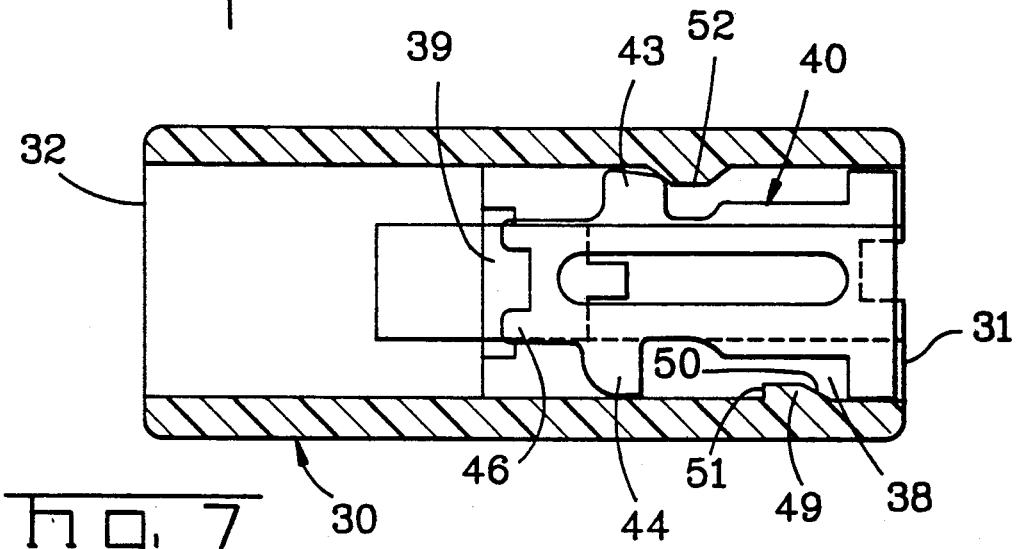
Fig. 7

DOUBLE LOCK CONNECTOR

This invention relates to a double lock connector wherein a contact is locked by a lance within a plastic housing and double locked by a part wedging the lance against displacement within the housing.

BACKGROUND OF THE INVENTION

A widely used electrical connector employs a receptacle contact into which is fitted a tab contact. One or both of the contacts may be crimped onto electrical wires or fitted onto devices such as switches, lamps, and the like supplied with current through such contacts. Typically, a plastic housing is employed with respect to one or the other of the contacts and some means is provided to lock the contact to the housing. Connectors of this type are disclosed in Japanese Patent 51-30270 and are represented in the views of the prior art shown in FIGS. 8 and 9 of this Application. There, the connectors include a housing 1 which includes internally a lance 10 having engaging surfaces 12 and 13 in the contact passage 9 formed by top wall 2, bottom wall 3, and two side walls 4. The contact 15 is inserted and held within the passage 9 of the housing, and has a contacting portion 18 with a floor part 19, side part 20, bent in a semi-circular form from each side thereof. A crimping barrel 16 joins the contact to a conductor 17 carried in an insulating jacket to form a wire. A latching tang 21 is shown in FIG. 8 to extend inwardly of the side parts 20 and latch to the terminal tab (not shown) connected by contact 15 in a well-known manner. The rear edge 22 of the contact as shown in FIGS. 8 and 9 includes surfaces which provide locking engagement by a lance 10 of the housing 1. As can be seen in FIG. 9, the contact 15 is inserted into the housing 1 with the lance 10 and the surfaces 12 and 13 thereof engaging the rear edge 22 of the contact to lock it within the housing. Also shown in these figures are the beveled front surfaces 6 and 7 which act to guide the insertion of a tab terminal through opening 8 within the contact 15.

Connectors as described are widely used in automotive and appliance applications wherein fairly large tensile forces may be expected, applied through the conductor 17 to the terminal tending to pull the connector apart, the receptacle part 15 away from the tab part causing a failure of connection. This is particularly true when the housing 1 is latched or locked in some fashion to put a strain on the latch 10. In vehicles, for example, road shocks and vibrational displacements can cause a failure of the latch and thus a failure of the connector.

The solution to the foregoing has been to provide some sort of double locking feature wherein, in addition to lance 10, a plastic element or other element is inserted through the housing in a manner to engage the terminal and prevent its displacement, acting in addition to the lance 10 to provide a so-called double locking feature. Typically, these approaches have resulted in a connector of an overall greater size than those not having the secondary, or double lock, feature.

Accordingly, it is an object of the present invention to provide an electrical connector having a double lock feature which is smaller than heretofore available. It is a further object to provide a connector having a double lock feature which is usable with existing connector contacts and with slight modifications to existing housings. It is still a further object of the invention to provide a receptacle and tab connector utilizing standard contacts and housings with the addition of a double lock part fitted completely within the housing.

SUMMARY OF THE INVENTION

The present invention achieves the foregoing objects through the provision of a double lock part which is molded of plastic to be of a thin, plate-like configuration adapted to be fitted within a housing of generally standard configuration. The double lock part includes a projection, or projections, which wedge a standard plastic lance within a connector housing against radial displacement away from a firm locking engagement with a contact inserted in such housing. The contact is of a receptacle type, including surfaces engaged by surfaces in the form of shoulders on a lance during axial insertion of the contact from the rear of the connector housing. The double locking part is inserted from the front of the housing to extend in behind the lance and effect the wedging providing the double locking action.

The double locking part further includes projecting surfaces which extend from the sides of the part and are staggered in an axial sense to engage projecting surfaces extending along the inner side walls of the housing in a first axial position partially inserted within the housing to thus latch the locking part to the housing and allow the insertion of a contact therewithin; and further, in a second fully seated and inserted position within the housing to effect the wedging of the lance thereof and the double locking feature. At least one of such projections operates to hold the double locking part within the housing against displacement thus assuring a wedging of the lance and the double locking feature providing a reliable locking of contact within the housing. The double locking part includes a slot extending along the length, behind the projecting surfaces to provide a resilience of the part and facilitate insertion and deformation of the projections in relation to the interior surfaces of the housing. The double locking part includes, at its end, beveled surfaces which facilitate the insertion of a tab contact into the receptacle contact of the invention.

IN THE DRAWINGS

FIG. 3 is an end, elevational view, taken from lines 3—3 in FIG. 1.

FIG. 4 is a plan view of the double locking part of the invention.

FIG. 5 is a side elevational view of the part of FIG. 4.

FIG. 6 is a plan and partially sectioned view of the connector housing having the double locking part partially inserted and latched therein.

DETAILED DESCRIPTION OF THE INVENTION

The preferred embodiment of the double lock type electrical connector, in accordance with the invention, will now be described in detail by referring to FIGS. 1 through 7.

Figures 1, 2, 7:
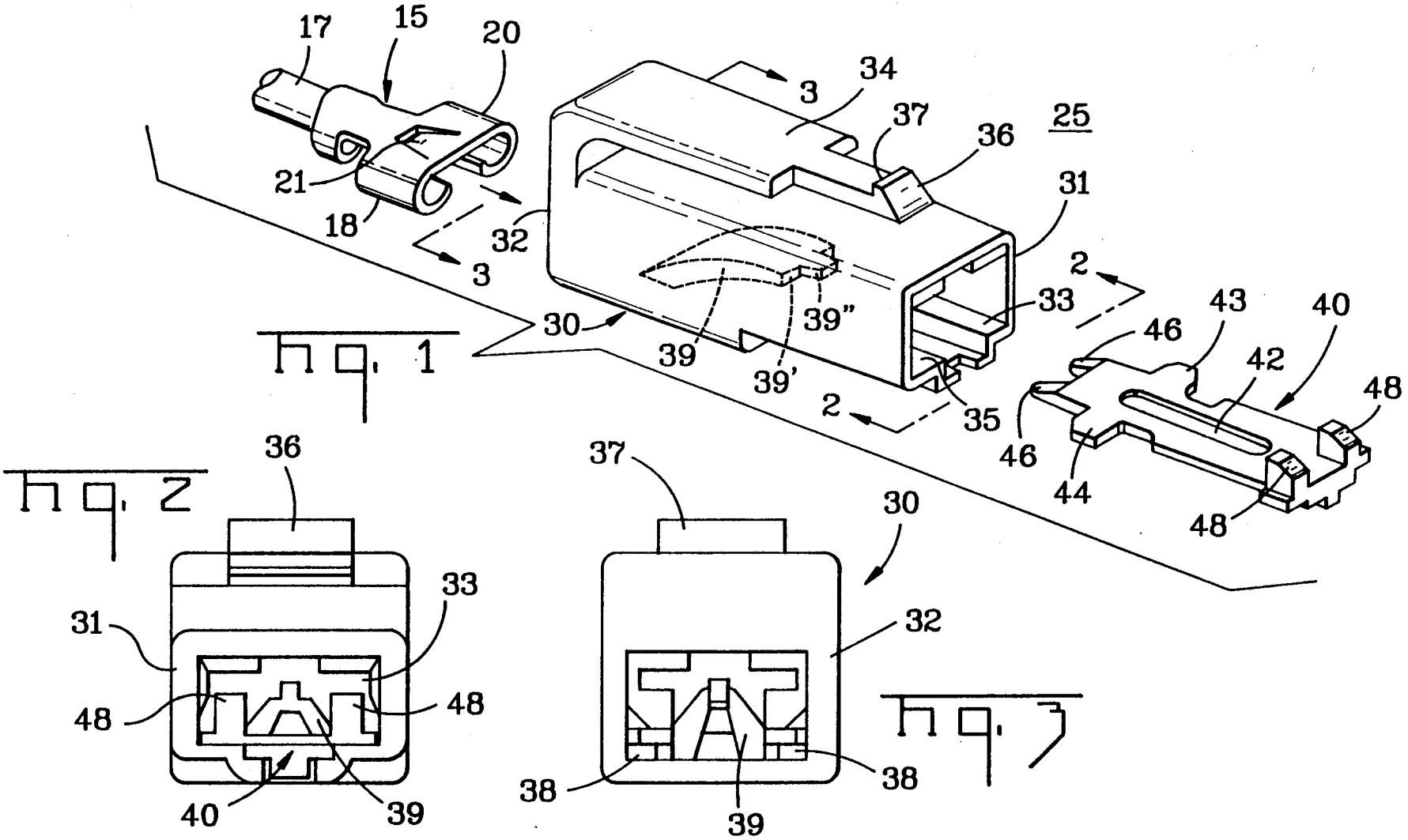
FIG. 1 is a perspective view, showing certain details in phantom of the housing of the invention and, exploded therefrom, a contact and a double locking part are positioned preparatory to insertion within the housing.
FIG. 2 is an end, elevational view, taken from lines 2—2 in FIG. 1.
FIG. 7 is a view of the connector and part of FIG. 6 with the part fully inserted and latched within the housing.

FIG. 1 shows a connector 25 of the double lock type to include a housing 30 which is a rectangular tube made by molding plastic and insulating material. The housing 30 has a generally rectangular opening or passage that extends through it from a front end 31 to a rear end 32. Exteriorly of the housing is a cantilever latch arm 34 which joins the rear end of the housing 32 and extends forwardly to its front end 31 to include a tapered or beveled surface 36 and a latch surface 37 thereadjacent. The latch arm 34 and associated surfaces would typically extend through and into a mating aperture or passage in a mating connector or panel to latch the housing 30 against displacement therefrom.

Figure 8:
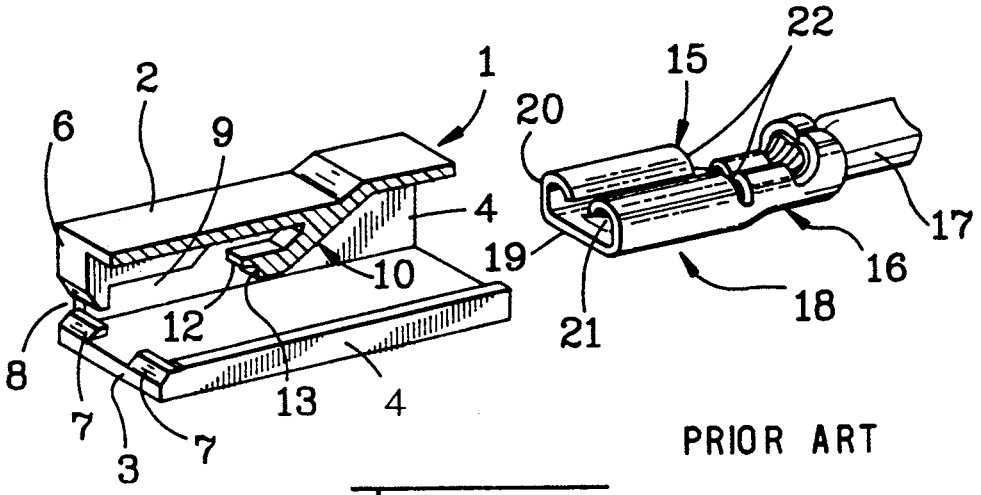
PRIOR ART Fig. 8
FIG. 8 is a perspective and exploded view showing a housing and contact in accordance with the prior art.
Figure 9:
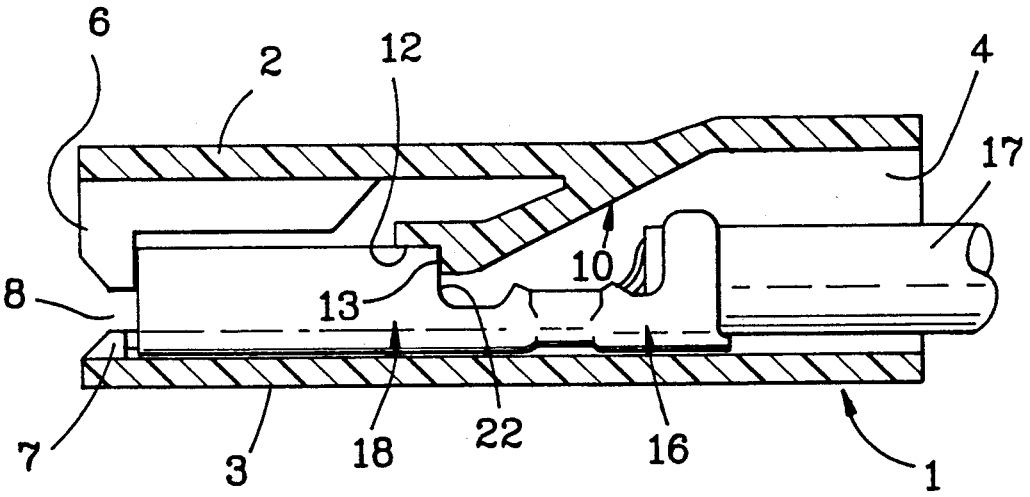
Fig. 9 PRIOR ART
FIG. 9 is a side, elevational and partially sectioned view showing the housing and contact of FIG. 8 as assembled.

As indicated in FIGS. 1 and 2, a passage 33 includes guiding grooves 38 which receive the plate-like double lock part 40. As can be seen from FIG. 1, the contact 15 which is analogous to the contact shown with respect to FIGS. 8 and 9, is inserted from the rear of housing 30 and the double locking part 40 is inserted from the front of the housing 30. FIG. 2 shows the part 40 inserted within the housing and further shows guide surfaces related to the front of housing 30, such surfaces extending within the housing. FIG. 3 shows guide surfaces and the latching part of the housing extending within the housing as viewed from the rear of such housing. FIG. 1 shows in phantom the housing lance 39 extending within the passage 33 and oriented to position surfaces 39' and 39'' on the end of such lance which engage the ends 22 of the contact 15 and lock such contact within the housing. These surfaces are analogous to surfaces 12 and 13 in FIG. 9. Contact 15 and housing 30, shown in FIG. 1, are inverted relative to the contact 15 and housing 1 depicted in FIGS. 8 and 9 as prior art.

The double locking part 40 may be seen in FIGS. 1, 2, 4, and 5 to include a thin, plate-like structure, preferably molded in one piece of insulating plastic material and having a number of projection features thereon. As can be seen in FIGS. 1 and 4, the part 40 has a centrally disposed slot 42 extending along the length thereof and behind a pair of projections 43 and 44 which extend out from the sides of the part as best seen in FIG. 4. To be noted is the fact that the projections 43 and 44 are offset in an axial sense relative to the part. At the inner or leading end of the double locking part 40 are a pair of projections 46 which serve to wedge the lance 39 in position to provide a double locking action. At the opposite end of the part 40 are a pair of projections 48 which include beveled surfaces as shown operable to help guide a tab terminal, not shown, inserted within the front end of the housing to engage the contact 15 and be interconnected thereto. The beveled surfaces on projection 48 are analogous to the beveled surfaces on projection 6 shown in FIGS. 8 and 9.

As can best be seen in FIGS. 6 and 7, the housing 30 includes, projecting into the interior passage 33, from the side walls thereof, a pair of projections 49 and 52. The projection 49 includes a beveled surface 50 and a further, sharply defined surface 51, essentially at right angles to the axis of passage 33. The projection 52 includes a pair of cam-like surfaces 53 and 54. As can be discerned from FIG. 6, the double locking part 40 is inserted partially within housing 30 to a point wherein the trailing edge surface of projection 44 engages surface 51 of projection 49 and precludes displacement of the part outwardly of the housing. The leading surface of projection 43 engages the camming surface 53 of projection 52 to preclude inward displacement of the part relative to housing 30. In this position, the position shown in FIG. 6, the part 40 is latched to housing 30, partially inserted within such housing. This facilitates not only having the housing 30 and part 40 preassembled, but allows the insertion of the contact 15 to the position of latching wherein the latch 39 and its surfaces engage the contact and hold it within the housing.

FIG. 7 shows the double locking part 40 fully inserted within the housing 30. It is to be noted that the trailing surface of projection 43 now engages the cam-like surface 54 of projection 52 to latch the part within the housing 30. An engagement with the projections 46 of the underside of lance 39 limits the insertion of part 40 interiorly of housing 30. In the position shown in FIG. 7, the double locking part 40 will wedge the lance 39 outwardly against radial displacement permitting relative movement of the contact 15 and housing 30. During insertion and displacement of the double locking part 40 within housing 30, the slot 42 facilitates inward displacement of the projections 43 and 44 so that the housing can receive the part 40 notwithstanding the projections 49 and 52. The presence of the slot 42 will, in like manner, facilitate the withdrawal of the double locking part 40 from housing 30 in the event it is necessary to separate the contact 15 from housing 30.

In this manner, a double locking function, assuring a lock of contact to housing, can be achieved.

As can be appreciated from the foregoing description, by selecting the dimensional shape and materials of the projections 43 and 44, and of the cam-like projections 49 and 52 of housing 30, the force design required to insert and fully seat the double locking part 40 can be readily adjusted as well as the force requirements to dislodge the part 40. The dimensioning of slot 42 can likewise alter the relationship of insertion and withdrawal forces.

The double lock type connector of the present invention is described relative to a preferred embodiment. It will be recognized by those skilled in the art that various modifications ar possible in each part, housing and double locking parts. For example, while it is ideal for contacts like that shown in FIGS. 8 and 9, the invention can, of course, be applied to various other well-known contacts by making the necessary changes in the housing lance configuration. Also, the double lock part 40 can be made into a variety of shapes which remain plate-like but provide further projections or details. The invention further contemplates, in a preferred embodiment, that the housing 30 may be made transparent or semi-transparent with the double lock part 40 given a more solid color, such as blue or yellow, which can allow visible examination as to the position of the double lock part within the housing.

Having now described the invention in terms intended to enable a preferred practice thereof, claims are appended, which are intended to define what is believed inventive.

We claim:

1. An electrical connector housing for securing an electrical contact therein, comprising:

a dielectric housing having a contact-receiving passage along which the electrical contact is to be disposed;

an integral lance extending from a surface of said housing and positioned within said contact-receiving passage for engagement with the electrical contact when positioned in said contact-receiving passage to maintain the electrical contact therein;

a lance-engaging member having a plate section insertable into said contact-receiving passage;

a first latch on said plate section and an interior surface of the contact-receiving passage of said housing and being in the same plane as that of said plate section maintaining said lance-engaging member at a first position in said contact-receiving passage to enable the electrical contact to be positioned within the contact-receiving passage so that said lance engages the electrical contact to maintain it therein; and a second latch on said plate section and an interior surface of the contact-receiving passage of said housing and being in the same plane as that of said plate section maintaining said lance-engaging member at a second position within said contact-receiving passage with said plate section engaging said lance to maintain said lance in engagement with the electrical contact thereby securing the electrical contact in the contact-receiving passage.

2. An electrical connector housing as claimed in claim 1, wherein said first latch includes first projections extending outwardly from the interior surface of said contact-receiving passage of said housing and from said plate section.

3. An electrical connector housing as claimed in claim 1, wherein said latch includes second projections extending outwardly from the interior surface of said contact-receiving passage of said housing and from said plate section.

4. An electrical connector housing as claimed in claim 1, wherein said first latch and said second latch are staggered along the axis of the contact-receiving passage.

5. An electrical connector housing as claimed in claim 1, wherein said plate section includes a slot therealong thereby rendering flexible said first and second latches on said plate section.

6. An electrical connector housing as claimed in claim 1, wherein said lance-engaging member has projections provided with beveled surfaces that assist in guiding a matable contact into the contact-receiving passage for electrical connection with the electrical contact.

7. An electrical connector housing for securing an electrical contact therein, comprising:

a dielectric housing having a contact-receiving passage extending therethrough along which the electrical contact is disposed;

an integral lance extending from an interior surface of said housing member and positioned within said contact-receiving passage for engagement with the electrical contact when positioned in said contact-receiving passage to maintain the electrical contact therein;

a lance-engaging member including a plate section insertable into said contact-receiving passage;

first projections provided by said plate section and said housing that are in the same plane as said plate section and are engageable with each other to maintain said lance-engaging member at a first position in said contact-receiving passage to enable the electrical contact to be positioned within the contact-receiving passage so that said lance engages the electrical contact to maintain it therein; and second projections provided by said plate section and said housing that are in the same plane as said plate section and are engageable with each other to maintain said lance-engaging member at a second position within said contact-receiving passage with said lance-engaging member engaging said lance to maintain said lance in engagement with the electrical contact thereby securing the electrical contact in the contact-receiving passage.

8. An electrical connector housing as claimed in claim 7, wherein said plate section includes a slot therealong thereby rendering the first and second projections on said lance-engaging member to be flexible.

9. An electrical connector housing as claimed in claim 1, wherein said first and second projections extend outwardly from the plate interior surface of said housing member and from said plate section.

10. An electrical connector housing as claimed in claim 1, wherein said first projections and said second projections are staggered.

11. An electrical connector housing as claimed in claim 7, wherein said lance-engaging member has projections provided with beveled surfaces that assist in guiding a matable contact into the contact-receiving passage for electrical connection with the electrical contact.

12. An electrical connector housing for securing an electrical contact therein comprising:

a dielectric housing member having a contact-receiving passage extending therethrough for receiving the electrical contact therealong;

an integral lance member extending from an interior surface of said housing member and positioned within said contact-receiving passage for engagement with the electrical contact when positioned in said contact-receiving passage to maintain the electrical contact therein;

a lance-engaging member insertable into said contact-receiving passage and having a lance-engaging section and a flexible-positioning section;

first positioning members on said flexible-positioning section and in contact-receiving passage to maintain said lance-engaging member at a first position in said contact-receiving passage to enable the electrical contact to be positioned within the contact-receiving passage so that said lance member engages the electrical contact to maintain it therein; and second positioning members on said flexible-positioning section and in said contact-receiving passage to maintain said lance-engaging member at a second position within said contact-receiving passage with said lance-engaging section engaging said lance member thereby maintaining the lance member in engagement with the electrical contact so that the electrical contact is secured in the contact-receiving passage.

13. An electrical connector housing as claimed in claim 12, wherein said first and second positioning members comprise projections extending outwardly from said flexible-positioning section and said contact-receiving passage.

14. An electrical connector housing as claimed in claim 13, wherein said projections are staggered.

* * * * *